US007670029B1

(12) United States Patent
Luo et al.

(10) Patent No.: US 7,670,029 B1
(45) Date of Patent: Mar. 2, 2010

(54) LED LAMP

(75) Inventors: Qiang Luo, Shenzhen (CN); Guang Yu, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/422,216

(22) Filed: Apr. 10, 2009

(30) Foreign Application Priority Data

Dec. 26, 2008 (CN) ..... 2008 1 0306586

(51) Int. Cl.
*F21V 29/00* (2006.01)

(52) U.S. Cl. ..... 362/294; 362/373; 362/376; 362/249.06

(58) Field of Classification Search ..... 362/294, 362/218, 249.06, 249.01, 249.14, 373, 249.02, 362/267, 376
See application file for complete search history.

(56) References Cited

U.S. PATENT DOCUMENTS

| | | | | |
|---|---|---|---|---|
| 4,042,819 | A * | 8/1977 | Dacal | 362/222 |
| 4,069,415 | A * | 1/1978 | Dacal | 362/263 |
| 4,229,780 | A * | 10/1980 | Nelson | 362/218 |
| 4,247,884 | A * | 1/1981 | McJunkin et al. | 362/164 |
| 7,434,964 | B1 * | 10/2008 | Zheng et al. | 362/294 |
| 2006/0049956 | A1 * | 3/2006 | Taylor et al. | 340/815.67 |
| 2009/0097241 | A1 * | 4/2009 | Xu et al. | 362/234 |

* cited by examiner

*Primary Examiner*—Thomas M Sember
(74) *Attorney, Agent, or Firm*—Frank R. Niranjan

(57) ABSTRACT

An LED safety lamp includes a cover, a heat-conductive plate thermally attached to and mounted on the cover, a heat sink thermally attached to and mounted on the heat-conductive plate, a plurality of LED modules attached to the heat sink, a transparent housing enclosing the heat sink and the LED modules and hermetically secured to the cover. The cover includes a hollow tube, a flameproof connector and a flexible component received in the hollow tube. The flexile component is depressed by the connector to expand thereby to seal the hollow tube and fix the electrical wires extending through the flexible component in position, thereby providing an excellent airproof effectiveness to the LED lamp.

14 Claims, 7 Drawing Sheets

LED LAMP

BACKGROUND

1. Technical Field

The disclosure relates to LED (light emitting diode) lamps and, more particularly, to an LED safety lamp having an explosion-protecting structure so that the LED safety lamp can be used in an explosive environment, such as a coal mine.

2. Description of Related Art

An LED lamp assembly is a type of solid-state lighting that utilizes light-emitting diodes (LEDs) as a source of illumination. An LED is a device for transferring electricity to light by using a theory that, if a current is made to flow in a forward direction through a junction region comprising two different semiconductors, electrons and holes are coupled at the junction region to generate a light beam. The LED has an advantage that it is resistant to shock, and has a nearly infinite lifetime under a specific condition; thus, the LED lamp is intended to be a cost-effective yet high quality replacement for incandescent and fluorescent lamps.

Due to advantages of the LED, the LED lamp is widely used for lighting.

Conventionally, an LED lamp includes a heat sink, an LED module attached to a bottom of the heat sink and a housing mounted on the heat sink to receive the LED module therein. The housing does not have a hermetical connection with the heat sink. When electric sparks accidently occur in the LED lamp, the sparks can ignite an explosion when the LED lamp is used in an explosive environment, for example, a coal mine. The coal mine has gases or coal dust which may enter the LED lamp to be ignited by the sparks to cause the coal mine to explode.

What is needed, therefore, is an LED safety lamp which can solve the above mentioned problems.

BRIEF DESCRIPTION OF THE DRAWINGS

Other advantages and novel features of the disclosure will become more apparent from the following detailed description of an embodiment/embodiments when taken in conjunction with the accompanying drawings.

DETAILED DESCRIPTION

Figure 1:
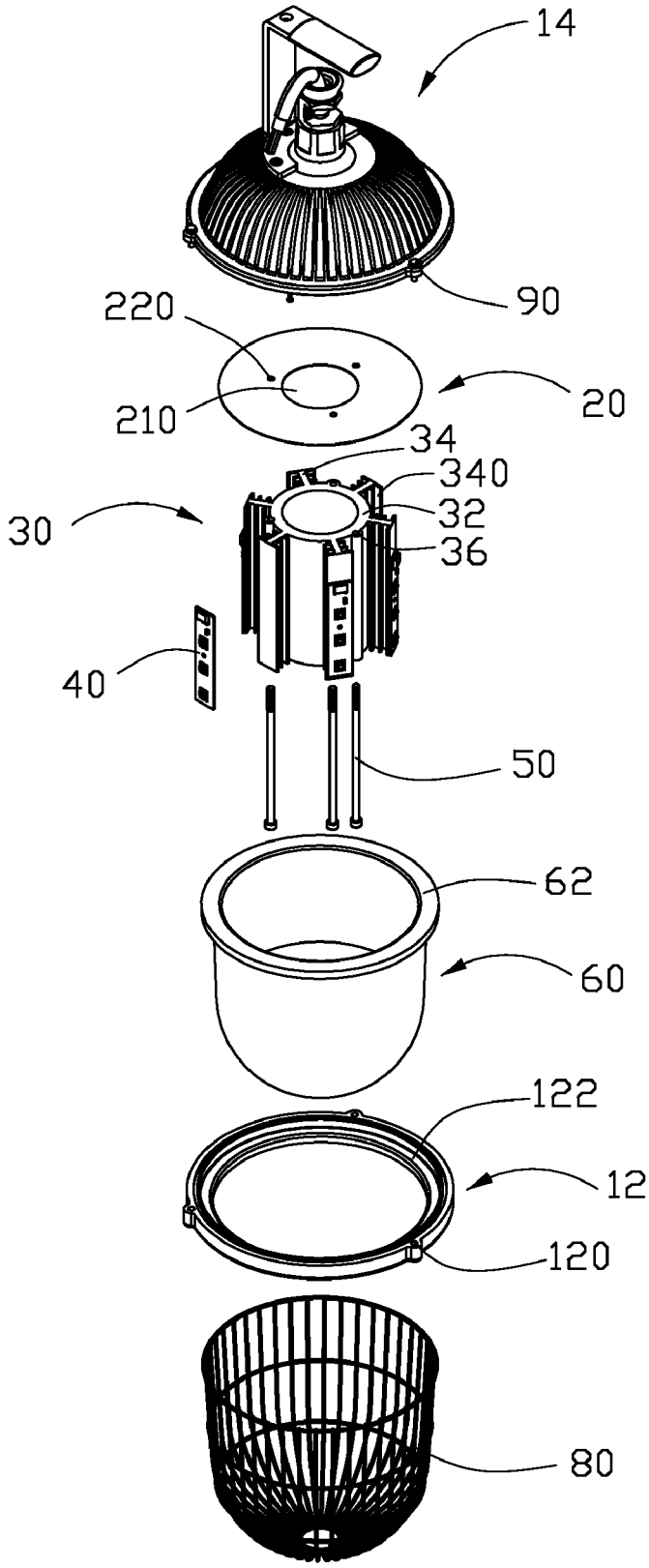
FIG. 1 is an isometric, exploded view of an LED safety lamp in accordance with an embodiment of the disclosure.
Figure 2:
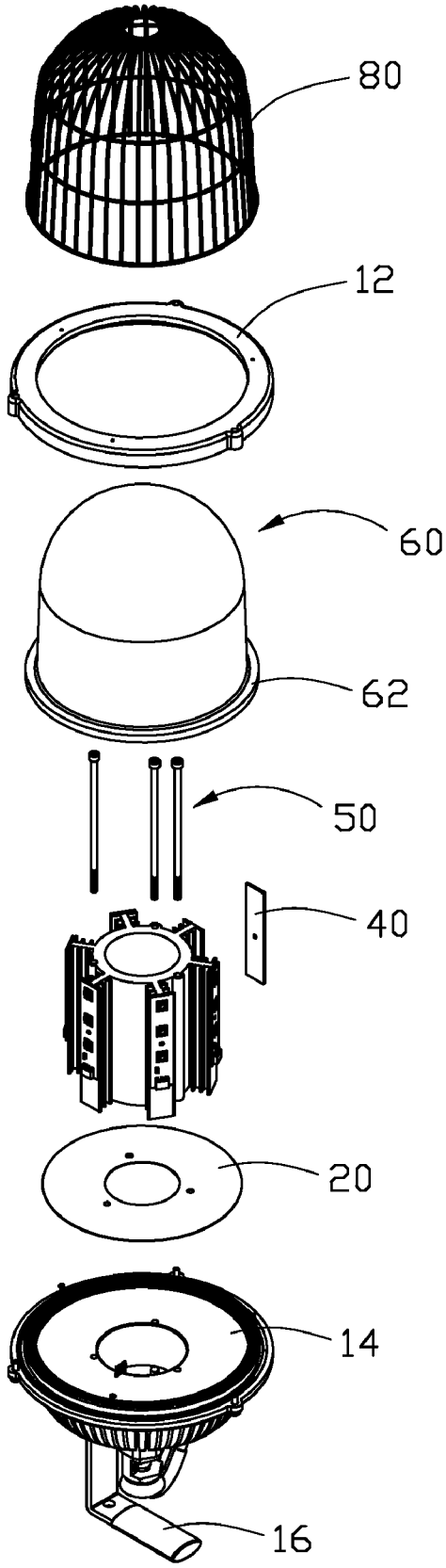
FIG. 2 is an inverted view of FIG. 1.
Figure 3:
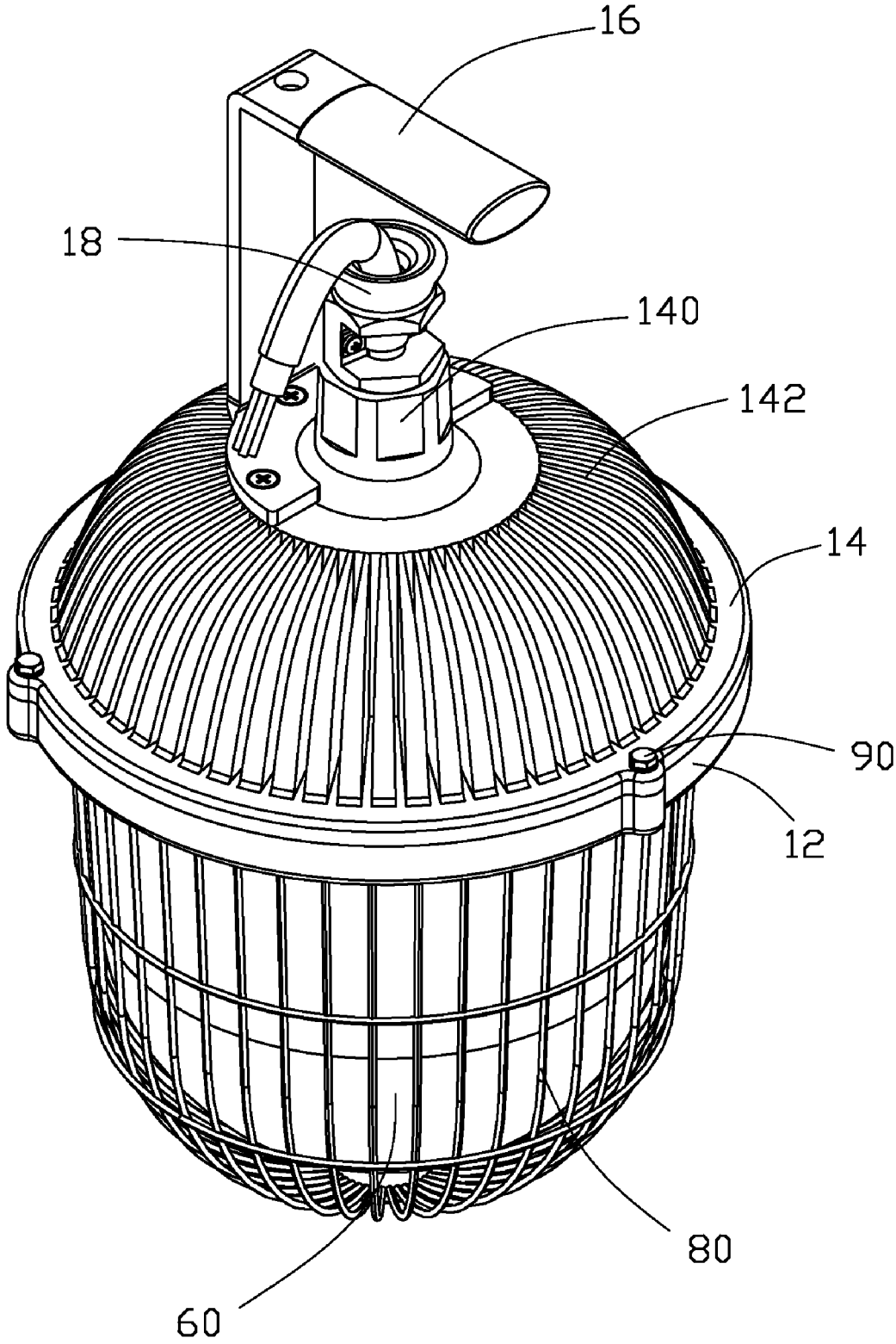
FIG. 3 is an assembled view of FIG. 1.

Referring to FIGS. 1-5 and 7, an LED safety lamp in accordance with an embodiment is shown. The LED safety lamp comprises a cover 10, a heat-conductive plate 20 thermally attached to and mounted on the cover 10, a heat sink 30 thermally attached to the heat-conductive plate 20, a plurality of LED modules 40 thermally attached to a periphery of the heat sink 30, a housing 60 enclosing the heat sink 30 and the LED modules 40 therein and engaging with the cover 10, and a protective cage 80 enclosing the housing 60 and fixed to the cover 10. The housing 60 is made of translucent glass or plastic. The protective cage 80 is made of reinforced plastic or metal wires, which can protect the housing 60 from collision.

The cover 10 is formed of a metal with good heat conductivity such as aluminum, copper or an alloy thereof. The cover 10 comprises an annular connecting base 12 and an upper cover 14 mounted on the connecting base 12. The connecting base 12 evenly defines three fixing holes 120 at a circumference thereof. Screws 90 extend through holes (not labeled) defined in the upper cover 14 to screw into the fixing holes 120 of the connecting base 12, thereby fixing the upper cover 14 to the connecting base 12. The connecting base 12 further defines an annular channel 122 at a circumference thereof, for receiving an annular flange 62 formed on a top edge of the housing 60 therein to sandwich the annular flange 62 of the top edge of the housing 60 between the upper cover 14 and the connecting base 12. A sealing gasket (not labeled) is received in the annular channel 122 to hermetically secure the housing 60 to the cover 10.

Figure 4:
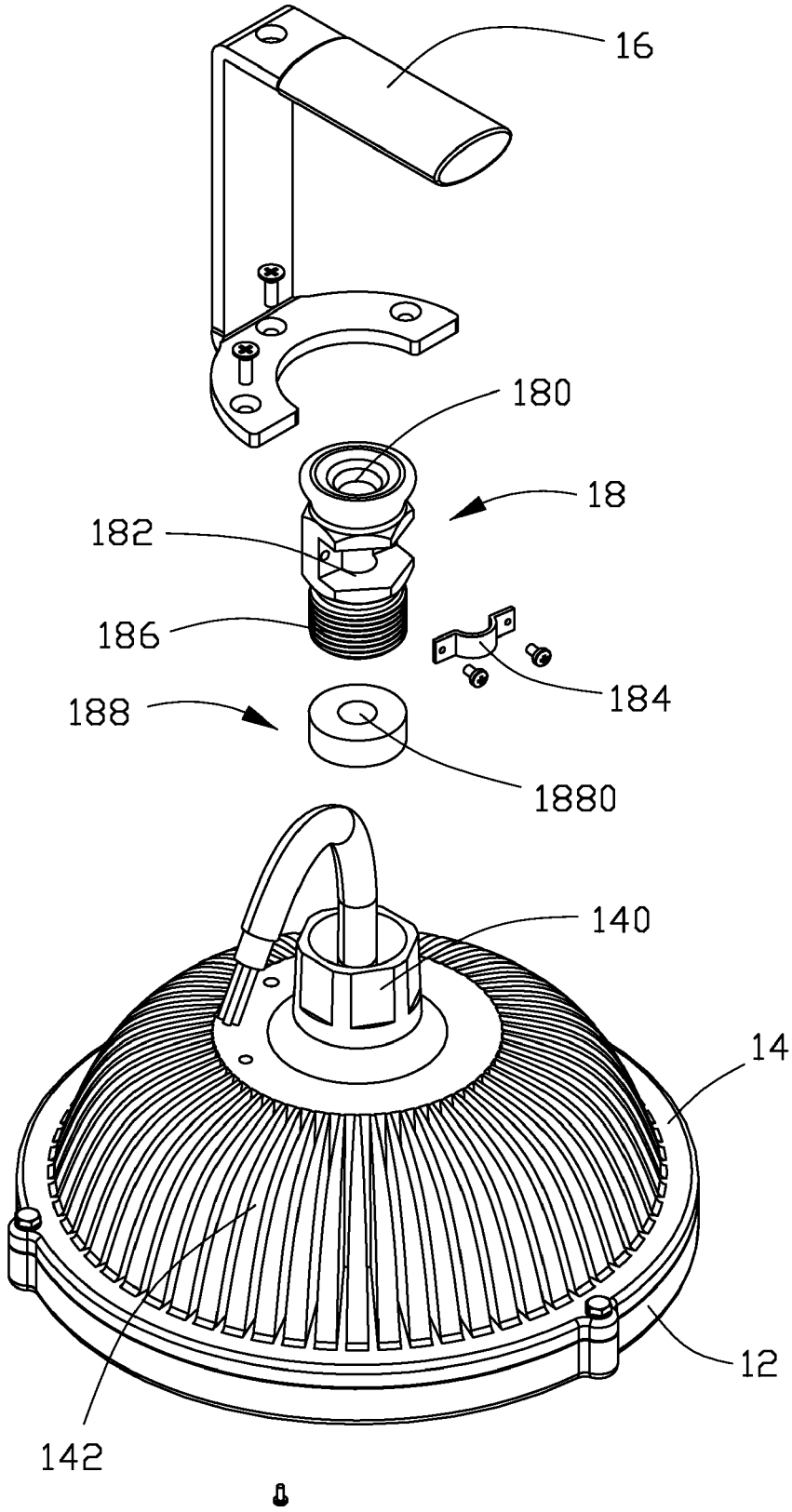
FIG. 4 is an exploded view of a cover of the LED safety lamp of FIG. 1.
Figure 5:
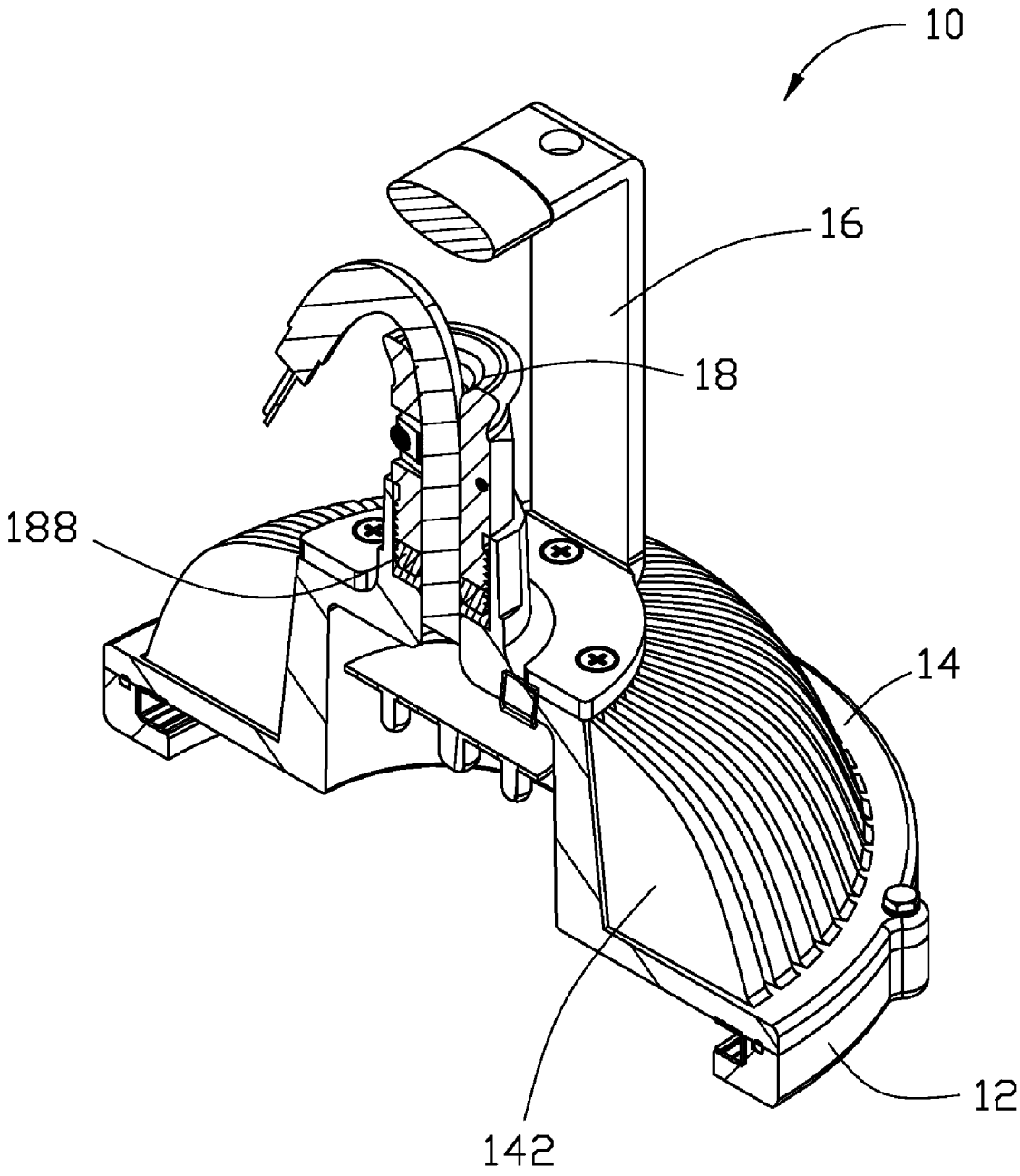
FIG. 5 is an isometric view of the cover of the LED safety lamp of FIG. 1, but viewed from a different aspect, wherein a half of the cover is cut away for clarity.

Particularly referring to FIGS. 4-5, the upper cover 14 comprises a hollow tube 140 extending upwardly and perpendicularly from a central portion thereof and a plurality of fins 142 radially formed on the upper cover 14 around the central portion thereof. The hollow tube 140 communicates an inside of the upper cover 14, whereby electrical wires (not labeled) connecting with a power source pass through the tube 140 to enter the upper cover 14 to electrically connect with the LED modules 40 received in the housing 60.

A flameproof connector 18 is hermetically connected to the hollow tube 140 and has a lower portion received in the hollow tube 140. The flameproof connector 18 defines an elongated through hole 180 through a center thereof for extension of the electrical wires therethrough to enter the upper cover 14. The flameproof connector 18 further defines a recession 182 in a middle portion thereof. A pressing sheet 184 is received in the recession 182 and tightly presses the electrical wires on an inner sidewall of the flameproof connector 18 by screws extending through the pressing sheet 184 and screwing in the inner sidewall of the flameproof connector 18. Thus, the electrical wires are securely positioned in the recession 182 of the flameproof connector 18, thereby avoiding movement of the electrical wires in the flameproof connector 18. The flameproof connector 18 comprises an external thread 186 defined in an outer circumferential surface of the lower portion thereof. The external thread 186 is located and configured corresponding to an internal thread (not shown) in an inner wall of the hollow tube 140 for screwing in the internal thread so as to secure the flameproof connector 18 to the hollow tube 140 of the upper cover 14 of the cover 10.

A flexible component 188 received in the hollow tube 140 is located below the flameproof connector 18 to seal the hollow tube 140 of the upper cover 14 of the cover 10. The flexible component 188 tightly encloses the electrical wires in the flameproof connector 18. The flexible component 188 defines a through hole 1880 in a center thereof, for extension of the electrical wires therethrough. The flexible component 188 is downwardly compressed when the external thread 186 of the flameproof connector 18 threadedly engages with the inner wall of the hollow tube 140. The flexible component 188 is thereby expanded to have an intimate engagement with the electrical wires extending through the through hole 1880 of the flexible component 188. Furthermore, the flexible component 188 is tightly sandwiched between a bottom of the flameproof connector 18 and a top of the upper cover 14 in the hollow tube 140, thereby hermetically securing the flameproof connector 18 to the tube 140 of the upper cover 14. Thus, gases or coal dust cannot enter the cover 10 and housing 60 through the hollow tube 140. And once electric sparks suddenly occur inside the LED safety lamp, it is safe to an outside of the LED safety lamp because of excellent sealing of the hollow tube 140. On the other hand, it is understood that the flexible component 188 which compresses the electrical wires in the through hole 1880 thereof can also avoid movement of the electrical wires in the flameproof connector 18 relative to the LED lamp, when the LED lamp is moved or subject to vibration. The securing of the electrical wires in position avoids the chance of occurrence of the electrical sparks.

For facilitating an operator to grasp the LED safety lamp, a handle 16 is mounted on the top portion of the upper cover 14 by screws.

Figure 7:
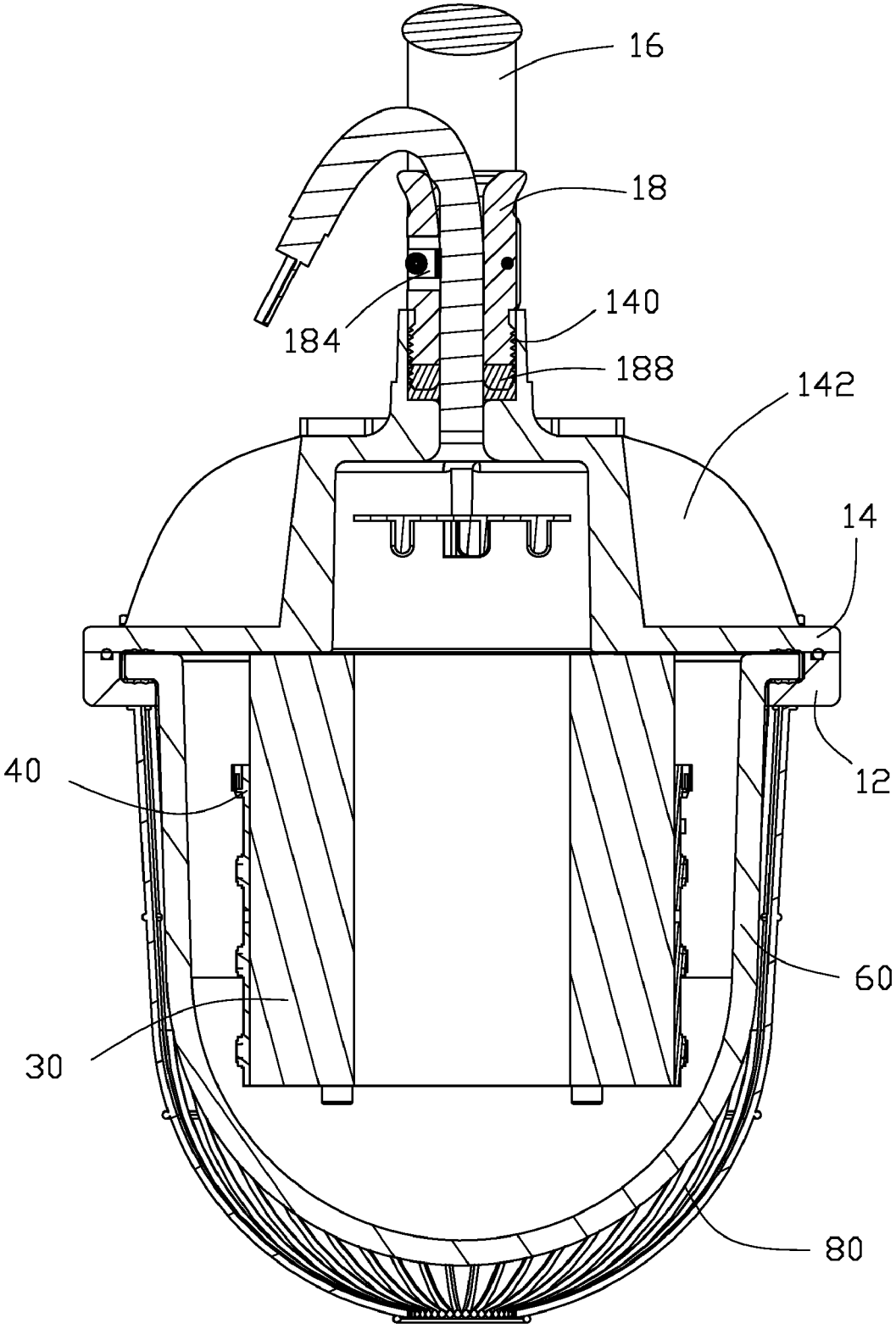
FIG. 7 is a cross-sectional view of FIG. 3.

Referring to FIGS. 1 and 7, the heat-conductive plate 20 is formed of a metal with good heat conductivity such as aluminum or copper and sandwiched between the heat sink 30 and the cover 10, thereby to conduct heat from the heat sink 30 to the cover 10. The heat-conductive plate 20 has an annular shape and defines a circular opening 210 in a center thereof, for extension of the electrical wires therethrough. Three mounting holes 220 are defined in the heat-conductive plate 20 and located symmetrically relative to the opening 210. Fasteners 50 extend through the heat sink 30 and the mounting holes 220 of the heat-conductive plate 20 to engage in a bottom of the upper cover 14 of the cover 10 to thereby mount the heat sink 30 and the heat-conductive plate 20 on the bottom of the upper cover 14 of the cover 10.

The heat sink 30 is integrally made of a metal with good heat conductivity, such as aluminum, copper or an alloy thereof. The heat sink 30 has a heat-conductive member at a center thereof. In this embodiment, the heat-conductive member is an elongated cylinder 32 with a through hole (not labeled) defined therein, corresponding to the opening 210 of the heat-conductive plate 20. The heat sink 30 has a plurality of conducting arms 34 extending outwardly from an outer wall of the cylinder 32. The conducting arms 34 are identical to each other and centrosymmetric relative to a central axis of the cylinder 32. The conducting arms 34 have a number which is corresponding to that of the LED modules 40; the number can be different in different embodiments. In this embodiment, the numbers of the conducting arms 34 and the LED modules 40 are both six. A plural pairs of fins 340 are formed on two opposite lateral sides of each of the conducting arms 34. Each pair of the fins 340 extend respectively and perpendicularly from two lateral sides of a corresponding conducting arm 34 and are symmetrical to each other in respect to the corresponding conducting arm 34. The fins 340 at a lateral side of each of the conducting arms 34 increase in length outwardly from the cylinder 32 to a distal end of the corresponding conducting arm 34. Each of the conducting arms 34 has a distal end terminating at an inner face of an outmost fin 340 thereof. An outer face (not labeled) of each outmost fin 340 is flat and used for thermally contacting with one of the LED modules 40, when the LED module 40 is mounted on the outer face. Three elongated fixing holes 36 are defined in the outer wall of the cylinder 32 and each located between two adjacent conducting arms 34. The fasteners 50 extend through the elongated fixing holes 36 of the heat sink 30 and the mounting holes 220 of the heat-conductive plate 20 and threadedly engage in the bottom of the upper cover 14 of the cover 10, thereby fixing the heat sink 30 to the upper cover 14 of the cover 10 and sandwiching the heat-conductive plate 20 between the upper cover 14 of the cover 10 and the heat sink 30.

The housing 60 acts as a lens, guiding light emitted by the LED modules 40 have a required distribution pattern. The housing 60 has a shape of a bullet and the annular flange 62 extending outwardly from a circumferential edge of the top thereof. As better seen in FIG. 7, the annular flange 62 is tightly sandwiched between the connecting base 12 and the upper cover 14 of the cover 10 when the upper cover 14 is fixed to the connecting base 12.

The protective cage 80 has a shape similar to that of the housing 60. The protective cage 80 is mounted on the connecting base 12 of the cover 10 via screws extending through a top edge of the protective cage 80 and screwing in the connecting base 12. The protective cage 80 has an outer periphery wider than that of the housing 60 so that there is a space between the outer periphery of the protective cage 80 and the outer periphery of the housing 60 when the protective cage 80 encloses the housing 60, as better seen in FIG. 7. Due to the space between the housing 60 and the protective cage 80, the protective cage 80 protects the housing 60 from being directly stricken when the LED safety lamp is subject to an unexpected external force.

Figure 6:
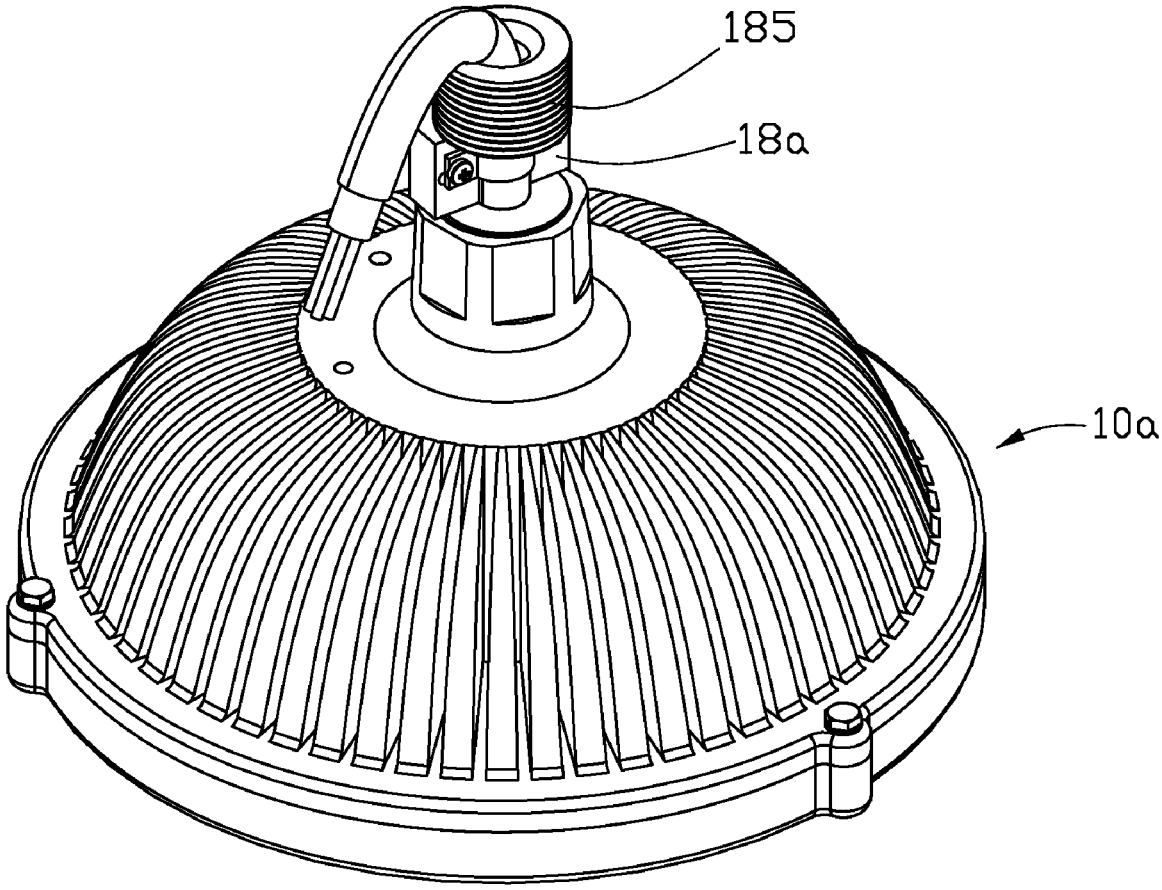
FIG. 6 is an assembled view of an alternative cover of the LED lamp of FIG. 1.

Referring to FIG. 6, an alternative cover **10*a* instead of the previous cover 10 of the disclosure is shown. Differences between the alternative cover 10*a* and the cover 10 is that the cover 10*a* comprises a flameproof connector 18*a*, which is used for connecting with a mounting post (not shown) to thereby position the LED safety lamp at a desired position by the mounting post. The handle 16 of the previous embodiment is omitted in this embodiment. The flameproof connector 18*a* comprises an external thread 185** at a top portion thereof, for threadedly engaging with an internal thread of the mounting post (not shown) to fix the LED safety lamp at the desired position.

In the disclosure, since the flexible component 188 received in the tube 140 of the cover 10 completely seals the hollow tube 140 of the upper cover 14, whereby the LED safety lamp has an excellent airproof effectiveness. Thus, the LED safety lamp is very safe to be use in an explosive environment, even if electric sparks suddenly occur inside the LED safety lamp.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An LED (light emitting diode) lamp comprising:

a cover comprising a hollow tube extending from a top portion thereof, adapted for extension of electrical wires extending therethrough to enter the cover, a flameproof connector received in the hollow tube and secured to the cover and a flexible component received in the hollow tube and located below the flameproof connector, the flexible component being compressed between the connector and the cover to expand to fix the electrical wires extending through the connector and the flexible component in position and seal the hollow tube;

a heat sink thermally attached to and mounted on the cover, the heat sink comprising a plurality of outer faces formed at a periphery of the heat sink; and a plurality of LED modules thermally attached to the outer faces of the heat sink, respectively; and a housing enclosing the heat sink and the LED modules, the housing being hermetically secured to the cover.

2. The LED lamp as claimed in claim 1, wherein the flameproof connector comprises a pressing sheet tightly pressing the electrical wires on an inner sidewall of the flameproof connector.

3. The LED lamp as claimed in claim 2, wherein the flameproof connector defines a recession, and the pressing sheet is received in the recession and mounted on the sidewall around the recession.

4. The LED lamp as claimed in claim 2, wherein the flameproof connector comprises a lower portion threadedly engages in an inner wall of the hollow tube.

5. The LED lamp as claimed in claim 1, wherein the cover comprises a connecting base and an upper cover hermetically secured to the connecting base and a circumferential edge of the housing is hermetically sandwiched between the upper cover and the connecting base.

6. The LED lamp as claimed in claim 5, wherein the upper cover comprises a plurality of fins extending from a center portion thereof.

7. The LED lamp as claimed in claim 6, wherein the connecting base comprises an annular channel receiving the circumferential edge of the housing therein.

8. The LED lamp as claimed in claim 1, further comprising a protective cage enclosing the housing and mounted on the cover, the protective cage having an outer periphery bigger than that of the housing to prevent the housing from being directly stricken.

9. The LED lamp as claimed in claim 1, further comprising a heat-conductive plate mounted on a bottom of the cover, the heat sink being thermally attached to and mounted on the heat-conductive plate.

10. The LED lamp as claimed in claim 1, wherein the heat sink comprises an elongated cylinder and a plurality of conducting arms extending outwardly from an outer wall of the cylinder, the outer faces being formed on ends of the conducting arms.

11. The LED lamp as claimed in claim 10, wherein each conducting arm comprises a plurality of fins extending from two opposite lateral sides thereof.

12. The LED lamp as claimed in claim 11, wherein the elongated cylinder of the heat sink defines a plurality of elongated holes in a circumferential edge thereof, adapted for extension of fasteners therethrough to mount the elongated cylinder of the heat sink on a bottom of the cover.

13. The LED lamp as claimed in claim 1, wherein a handle is attached to the cover to facilitate a grasp of the LED lamp.

14. The LED lamp as claimed in claim 1, wherein the flameproof connector forms an outer thread in an upper portion thereof, adapted for threadedly connecting with a mounting post.

* * * * *